US005339608A

United States Patent [19]

Hollis et al.

[11] Patent Number: 5,339,608

[45] Date of Patent: Aug. 23, 1994

[54] MOUNTING CLIP FOR VINYL SIDING

[75] Inventors: Tommy W. Hollis, Kingwood; Hugh L. Morris, Woodlands, both of Tex.

[73] Assignee: C & H Enterprises, Conroe, Tex.

[21] Appl. No.: 970,147

[22] Filed: Nov. 2, 1992

Related U.S. Application Data

[63] Continuation of Ser. No. 808,186, Dec. 13, 1991.

[51] Int. Cl.[5] ..... E04D 1/34

[52] U.S. Cl. ..... 52/545; 52/547; 52/543; 52/520; 52/478

[58] Field of Search ..... 52/698, 478, 489, 506, 52/520, 528, 543, 544, 545, 547

[56] References Cited

U.S. PATENT DOCUMENTS 4,864,787 9/1989 Bukowski ..... 57/545 X
4,947,609 8/1990 Champagne ..... 52/545

FOREIGN PATENT DOCUMENTS 460525 1/1937 United Kingdom .

*Primary Examiner*—Carl D. Friedman
*Assistant Examiner*—Creighton Smith
*Attorney, Agent, or Firm*—Russell J. Egan

[57] ABSTRACT

A clip for mounting top panels of vinyl siding is formed from a continuous strip of metal with three contiguous portions joined by respective bights defining a pair of oppositely directed resilient panel gripping portions. One of the resilient portions engages the top panel and the other engages the next to top panel in such fashion as to allow limited relative float of the panels.

2 Claims, 1 Drawing Sheet

MOUNTING CLIP FOR VINYL SIDING

This is a continuation of copending U.S. patent application Ser. No. 07/808,186, filed Dec. 13, 1991.

BACKGROUND OF THE INVENTION

1. The Field of the Invention

The present invention is a mounting clip for securing the top row of vinyl siding between the next to top row and the soffit and in particular to a clip which will obviate marring of the surface of any of the mating panels while allowing relative motion between panels.

2. The Prior Art

There are numerous reason the building industry has had a preference for the use of vinyl siding. These reasons include, but are not restricted to, the fact that such siding has low wear and maintenance characteristics. Vinyl panels are generally extruded or formed into individual panels 12 feet long and 8 or 10 inches wide. Each panel is profiled to simulate one or more rows of the traditional lapped wooden siding and can even have a textured finish to complete the illusion of wooden siding. The panels are made with permanent coloring and with a variety of surface finishes all leading to the above mentioned low maintenance characteristics.

The rows of vinyl siding are installed with the panels in overlappinq and/or interlocking rows starting from the bottom of the wall. Each panel has an inturned bottom butt which is received in a downwardly directed channel configuration of the upper butt of the adjacent panel. The panel used at the top of a section of wall can be either a specially formed panel or, more likely, a standard panel modified to remove at least the upper butt and what ever panel surface necessary to make a proper fit. The lower edge of this panel engages the butt of the upper most row of siding and its upper edge cut or formed edge is received under the bottom lip of a finish trim. This is where there has been a problem in the past in that these top panels do not have the upper nail strip of the standard panel covering the remainder of the wall. No vinyl panel, regardless of its configuration, can have nails driven through the face. This would clearly mar the finished appearance while preventing the relative movement of the panels which is necessary to accommodate for differences in expansion and contraction due to changes in ambient temperature conditions.

Thus far one effort to come up with a solution to this problem can be found in U. S. Pat. No. 4,947,609. However, the clip described therein is not without problems. First, it has a rather complicated configuration involving two downwardly directed channels which make it difficult and expensive to manufacture. Second, it relies upon engaging in the nail slots in a panel thereby limiting float and causing the possibility of bulging of the panel with changes in ambient weather conditions.

SUMMARY OF THE INVENTION

The present invention has as an object to make it easier to install the top row of vinyl panels without the need for face nailing thereby making the installer's job easier, faster and more versatile. The subject clip also allows the panel to expand and contract freely.

The subject vinyl panel mounting clip is a continuous metal member formed from a metal blank to define a continuous surface of curvature three portions of which are joined by two bights to define two oppositely directed resilient panel engaging sections. The subject clip also includes a transverse nail slot.

BRIEF DESCRIPTION OF THE DRAWINGS

The present invention will now be described by way of example with reference to the accompanying drawings in which.

DETAILED DESCRIPTION OF THE PREFERRED EMBODIMENT

Figure 2:
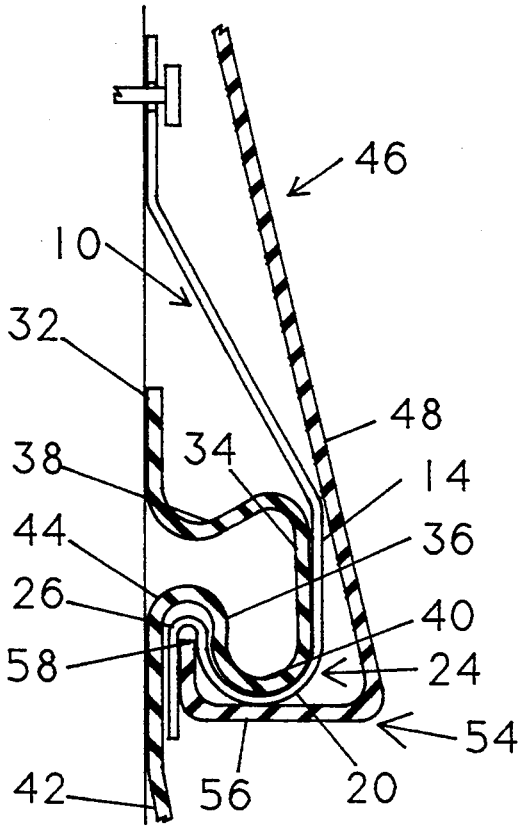
FIG. 2 is a vertical section, on a larger scale, showing the subject invention securing a top panel in place.
Figure 1:
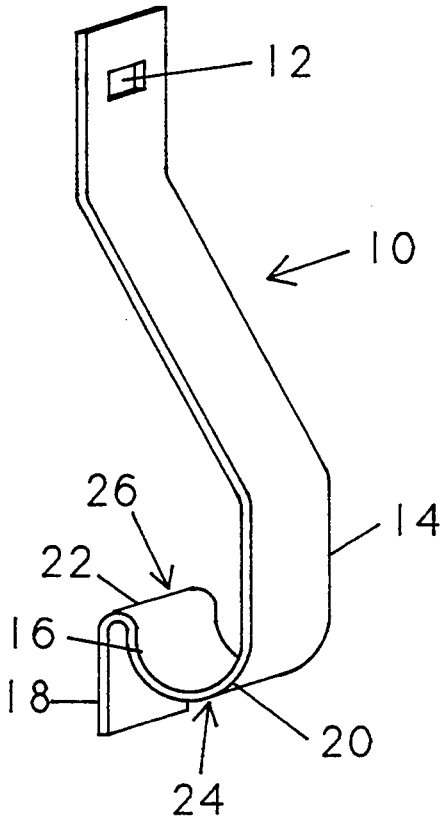
FIG. 1 is a perspective view of the subject clip.
Figure 3:
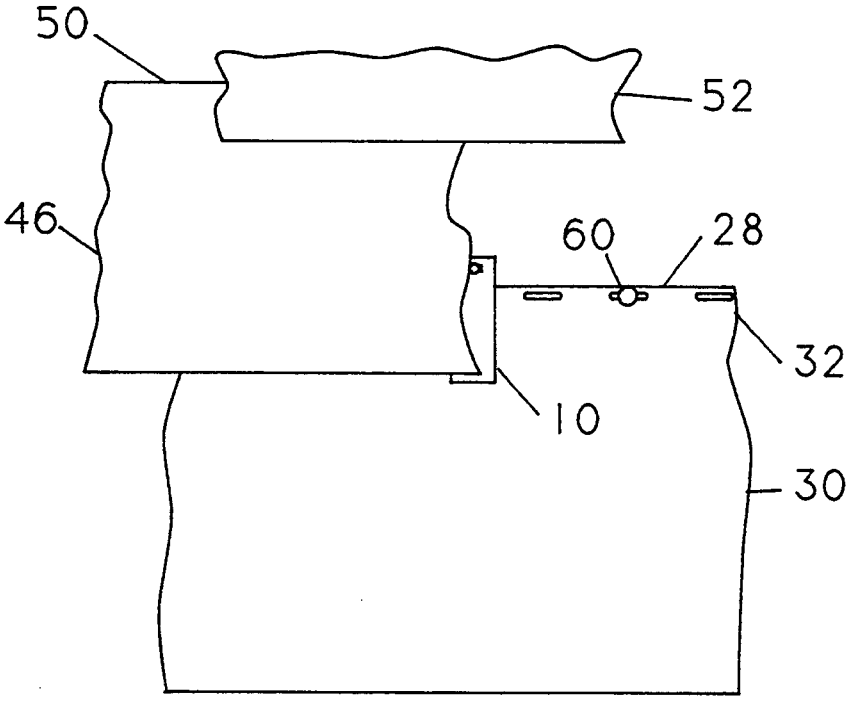
FIG. 3 is a front elevation showing the subject invention as it would be used to mount a top panel on a typical wall.

The subject vinyl panel mounting clip 10 is preferably formed from aluminum stock about 0,018 to 0,024 thick, about one inch wide and about three and three quarters inches long. It is a continuous unitary member having a transverse nailing slot 12 approximately one half inch from its upper free end. The rest of the clip 10 has a continuous curvature including three contiguous portions 14,16,18 joined by respective bights 20,22 to define a pair of oppositely directed, resilient panel gripping sections 24,26.

The upper edge 28 of the next-to-top row panel 30 has a conventional upper butt configuration including a nail slot 32 and portions 34,36 connected by bights 38,40, forming the upper butt which is connected to the panel face 42 by bight 44. The bottom of the panel 30 has a lower butt (not shown) profiled to engage the upper butt of a like panel (also not shown).

The top out panel 46 has a face portion 48 with an upper edge 50 profiled to be received under the lower edge of a finish trim panel 52. The lower edge of top out panel 46 has a lower butt 54 formed by an inwardly directed flange 56 and an upwardly directed mating flange 58.

The subject mounting clips 10 are mounted along the upper edge 28 of panel 30 with one resilient portion 26 engaging in the upper butt of the panel. The subject mounting clips 10 are spaced apart approximately 18" and are nailed in place by nails 60 driven through the slots 12 into the support wall. Since the slots 12 are transverse, this allows limited lateral sliding movement of the clip 10 with respect to the nail 60. The top out panel 46 has its profiled upper edge 50 inserted under the finish trim panel 52 and the bottom edge snapped over the mounting clip 10 to be resiliently engaged and secured in place.

The present invention may be subject to many modifications and changes without departing from the spirit or essential characteristics thereof- The present embodiment should therefor be considered in all respects as being illustrative and not restrictive of the scope of the invention.

We claim:

1. A mounting clip for attaching vinyl siding to a building structure, said clip comprising:

a continuous elongated metal strip having upper and lower ends with said lower end formed in a continuous curvature defining panel engaging means profiled to resiliently grip an upper butt of a next-to-top row panel and resiliently receive therein a lower butt of a top out panel, said panel engaging means terminating in an end portion extending outwardly beneath and supporting said top out panel, said upper and lower ends connected by an intermediate segment extending over said next-to-top row panel into abutting relationship with underlying building structure with said upper end lying flat thereagainst and extending away from said lower end, said upper end having a transverse nailing slot therein.

2. A mounting clip for attaching vinyl siding to a building structure, said clip comprising:

a continuous elongated metal strip having upper and lower ends with a transverse nailing slot adjacent said upper end and a continuous curvature towards the lower end defining panel engaging means profiled to resiliently grip an outwardly and downwardly directed upper butt of a next-to-top row panel and resiliently receive therein an upwardly directed lower butt of a top out panel, said curvature terminating in an end portion extending outwardly beneath and supportin said top out panel, an intermediate segment connecting said upper and lower ends and making only incidental contact with said upper butt while extending to said building structure so that said upper end lies flat thereagainst and extends away from said lower end.

* * * * *